US009252475B2

(12) United States Patent
Milyakh et al.

(10) Patent No.: US 9,252,475 B2
(45) Date of Patent: Feb. 2, 2016

(54) ADAPTOR FOR CONNECTING A MICROSTRIP LINE TO A WAVEGUIDE USING A CONDUCTIVE PATCH AND A STUB HOLE

(71) Applicant: ACE TECHNOLOGIES CORPORATION, Incheon (KR)

(72) Inventors: Yaroslav Milyakh, Incheon (KR); Hak-kyoun Kim, Seoul (KR); Da Young Sun, Jeollanam-do (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 0 days.

(21) Appl. No.: 14/270,240

(22) Filed: May 5, 2014

(65) Prior Publication Data

US 2014/0333389 A1 Nov. 13, 2014

(30) Foreign Application Priority Data

May 9, 2013 (KR) ..... 10-2013-0052361

(51) Int. Cl.
*H01P 5/107* (2006.01)

(52) U.S. Cl.
CPC ..... *H01P 5/107* (2013.01)

(58) Field of Classification Search
CPC ..... H01P 5/107
USPC ..... 333/26
See application file for complete search history.

(56) References Cited

U.S. PATENT DOCUMENTS

| | | | | |
|---|---|---|---|---|
| 2011/0050356 | A1* | 3/2011 | Nakamura et al. | 333/26 |
| 2012/0032750 | A1* | 2/2012 | Feil | 333/26 |
| 2012/0176285 | A1* | 7/2012 | Morgia | 343/772 |

* cited by examiner

*Primary Examiner* — Benny Lee
(74) *Attorney, Agent, or Firm* — TechLaw LLP

(57) ABSTRACT

An adaptor for connecting a microstrip line and a waveguide is disclosed that includes a microstrip line part and a waveguide part. The microstrip line part includes a microstrip port pattern and a patch pattern on an upper portion of a substrate, where the patch pattern is joined to an end portion of the microstrip port pattern. The waveguide part includes a waveguide hole, for transferring a signal provided from the patch pattern; a channel hole, which is formed in an area for joining with the microstrip line part, is formed along a first direction orthogonal to a direction of the waveguide hole in correspondence to the microstrip port pattern, and is connected with the waveguide hole; and a stub hole, which is connected with the waveguide hole and is formed in an area for joining with the microstrip line part along a second direction opposite to the first direction.

5 Claims, 7 Drawing Sheets

ADAPTOR FOR CONNECTING A MICROSTRIP LINE TO A WAVEGUIDE USING A CONDUCTIVE PATCH AND A STUB HOLE

CROSS-REFERENCE TO RELATED APPLICATIONS

This application claims the benefit of Korean Patent Application No. 10-2013-0052361, filed with the Korean Intellectual Property Office on May 9, 2013, the disclosure of which is incorporated herein by reference in its entirety.

BACKGROUND

1. Technical Field

The present invention relates to an adaptor for connecting a microstrip line and a waveguide.

2. Description of the Related Art

An adaptor for connecting a microstrip line with a waveguide may be used to provide the signals of the microstrip line to the waveguide or provide the signals of the waveguide to the microstrip line.

For example, an adaptor can be used when signals received at a radar antenna implemented in the form of a microstrip line are to be provided to a waveguide or when the signals of the waveguide are to be provided to a radar antenna implemented in the form of a microstrip line.

FIG. 1 is a cross-sectional view of a typical adaptor for connecting a microstrip line with a waveguide according to the related art, FIG. 2 is a perspective view of a typical adaptor for connecting a microstrip line with a waveguide according to the related art with the upper portion removed, and FIG. 3 is a perspective view of a typical adaptor for connecting a microstrip line with a waveguide according to the related art as seen from below.

Referring to FIG. 1 through FIG. 3, an adaptor according to the related art may have a waveguide part 110 (FIG. 1) joined to an upper portion of a microstrip line part 100 (FIG. 1) and may have a termination member 120 (FIGS. 1, 3) joined to a lower portion of the microstrip line part 100 (FIG. 1).

In FIG. 2, the microstrip line part 100 (FIG. 1) has a microstrip pattern formed on a substrate, and includes a microstrip port 200, for connecting to another microstrip device such as a microstrip antenna, etc., and a probe 202, for coupling to a waveguide. A ground conductor 204 may be formed in other areas of the substrate with a particular distance separated from the port 200 and probe 202.

Referring to FIG. 3, the lower portion of the substrate in the microstrip line part 100 (FIG. 1) can have a ground conductor 206 formed in all areas other than the area where the termination member 120 is joined.

In FIG. 1-3, the waveguide part 110 may be joined to an upper portion of the microstrip line part 100, and the ground conductor 204 may not be formed in the area where the waveguide part 110 is joined.

The signals of the microstrip line part 100 may be provided from the probe 202 to the waveguide part 110. The waveguide part 110 may be structured to have a waveguide hole formed therein, and the signals of the microstrip line part 100 may be transmitted through the waveguide hole.

The termination member 120 joined to a lower portion of the microstrip line part may be closed at the bottom and may have a hole having the same size as that of the waveguide part 110.

The termination member 120 may function such that the signals provided from the probe 202 are suitably coupled to the waveguide part 110. That is, the termination member 120 may function such that the signals from the probe 202 are provided to the waveguide part 110 on the upper portion of the substrate and are not coupled to the lower portion of the substrate. The termination member 120 may have a length that is a quarter (¼) of the wavelength corresponding to the operating frequency.

Thus, an adaptor for connecting a microstrip line and a waveguide according to the related art can be structured to have a waveguide part 110 and a termination member 120 joined to the upper and lower portions of a microstrip line part, respectively.

With an adaptor according to the related art having the structure described above, it may be difficult to join another substrate onto the substrate of the microstrip line part 100, and even if another type of substrate (e.g. a substrate having a circuit formed thereon) is joined, it may be difficult to suitably implement coupling of signals.

Thus, with an adaptor based on the related art, it may be necessary to include the microstrip line part as a single layer, and it may be difficult to implement the microstrip line part in multiple layers.

SUMMARY OF THE INVENTION

An aspect of the invention proposes an adaptor for connecting a microstrip line with a waveguide that can be applied to microstrip lines having a multi-layer structure.

Another aspect of the invention proposes an adaptor for connecting a microstrip line with a waveguide that can employ various structures on the lower portion of the substrate of the microstrip line.

One aspect of the invention provides an adaptor for connecting a microstrip line and a waveguide that includes a microstrip line part and a waveguide part. The microstrip line part includes a microstrip port pattern and a patch pattern on an upper portion of a substrate, where the patch pattern is joined to an end portion of the microstrip port pattern. The waveguide part includes a waveguide hole, for transferring a signal provided from the patch pattern; a channel hole, which is formed in an area for joining with the microstrip line part, is formed along a first direction orthogonal to a direction of the waveguide hole in correspondence to the microstrip port pattern, and is connected with the waveguide hole; and a stub hole, which is connected with the waveguide hole and is formed in an area for joining with the microstrip line part along a second direction opposite to the first direction. The waveguide part may be joined to an upper portion of the microstrip line part.

On the upper portion of the substrate, a ground pattern may be formed separated by a particular distance from the microstrip port pattern and the patch pattern to be formed around the microstrip port pattern and the patch pattern.

The stub hole may be formed such that the distance from a center portion of the waveguide hole to an end portion of the stub hole is a quarter (¼) of the wavelength.

The waveguide hole may be formed penetrating through a housing of the waveguide part.

The channel hole may be formed in a direction orthogonal to the waveguide hole from the waveguide hole up to a housing of the waveguide part.

An adaptor based on certain embodiments of the invention can be applied to microstrip lines having a multi-layer structure and can employ various structures on the lower portion of the substrate of the microstrip line.

Additional aspects and advantages of the present invention will be set forth in part in the description which follows, and in part will be obvious from the description, or may be learned by practice of the invention.

DETAILED DESCRIPTION OF THE INVENTION

Figure 1:
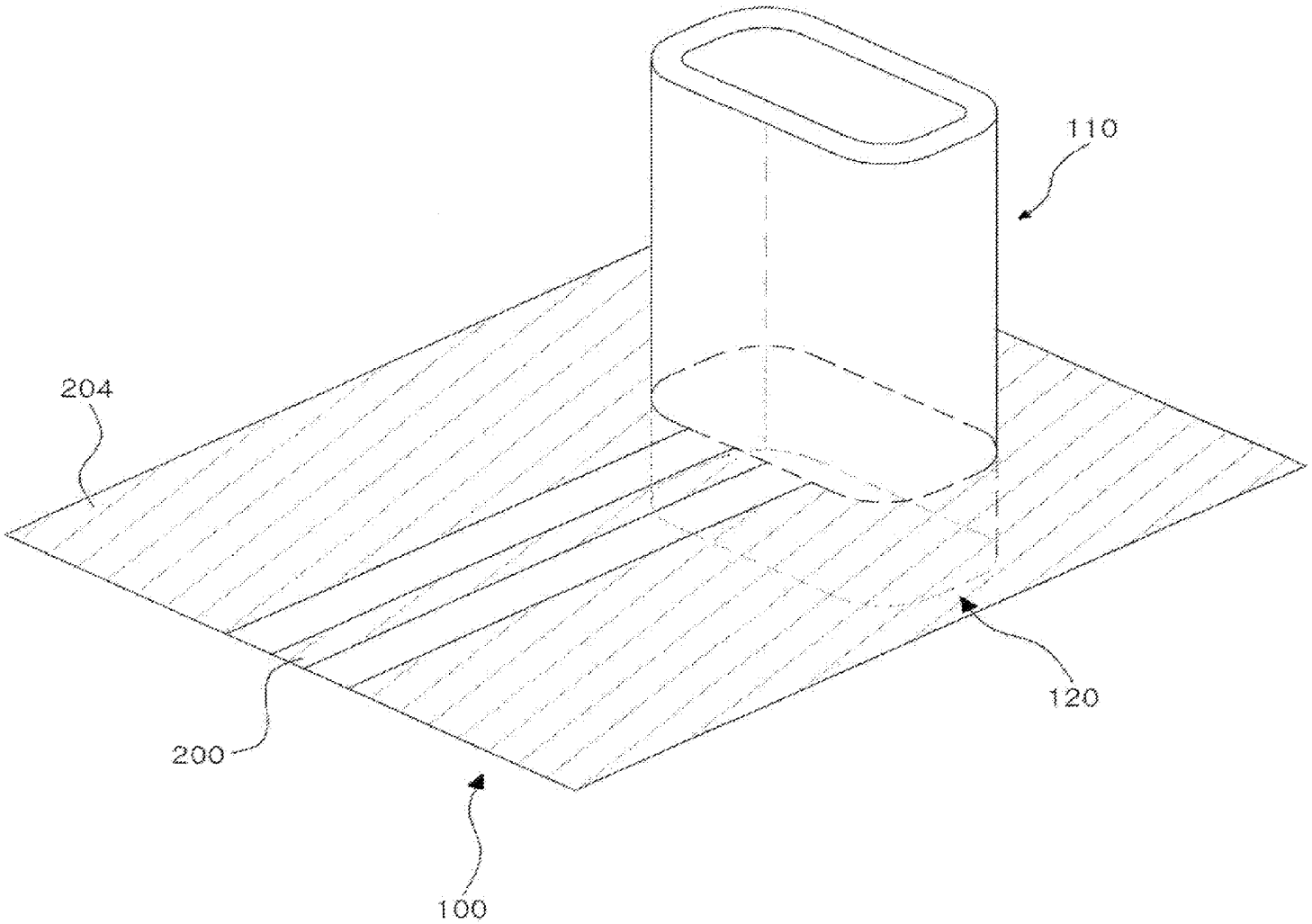
FIG. 1 (Prior Art)
FIG. 1 is a cross-sectional view of a typical adaptor for connecting a microstrip line with a waveguide according to the related art.
Figure 2:
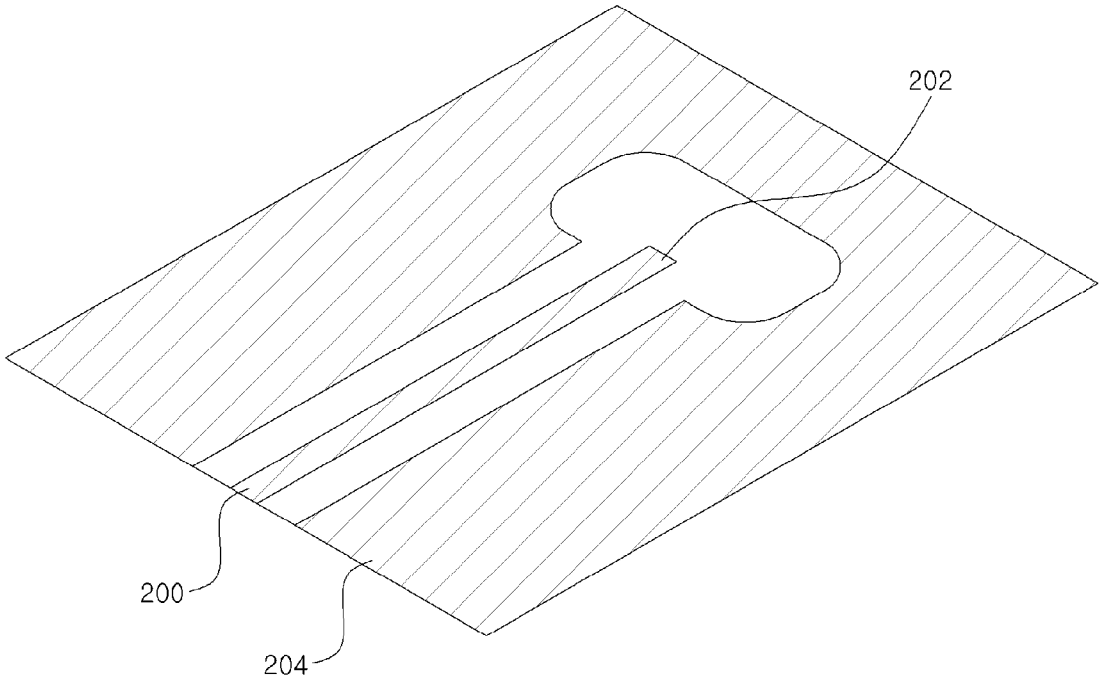
FIG. 2 (PRIOR ART)
FIG. 2 is a perspective view of a typical adaptor for connecting a microstrip line with a waveguide according to the related art, with the upper portion removed.
Figure 3:
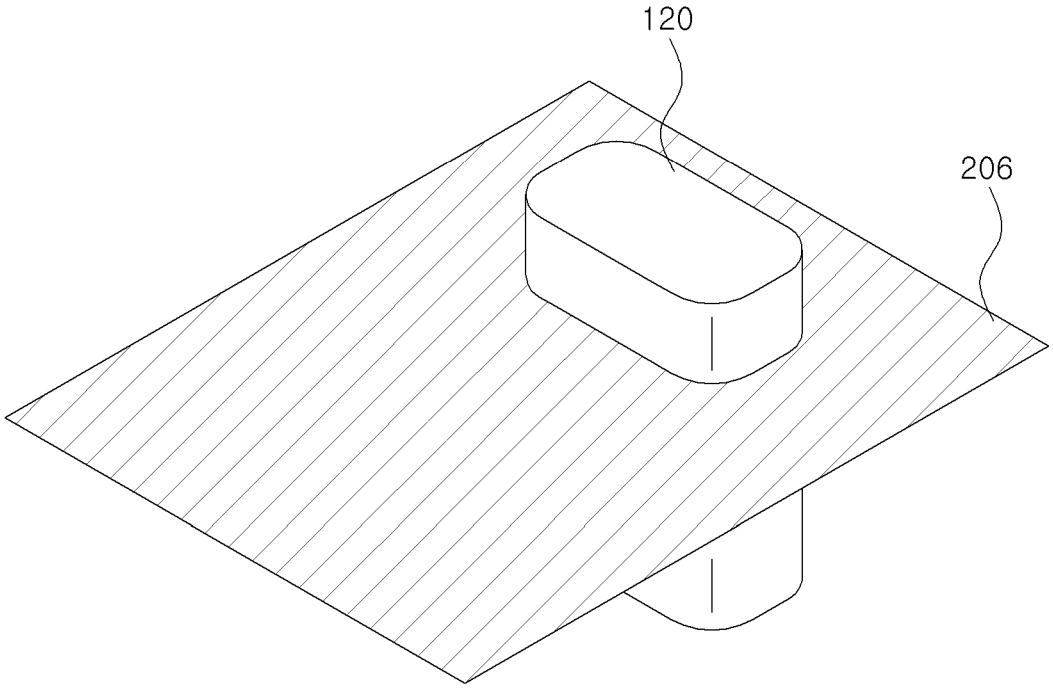
FIG. 3 (PRIOR ART)
FIG. 3 is a perspective view of a typical adaptor for connecting a microstrip line with a waveguide according to the related art, as seen from below.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

Figure 4:
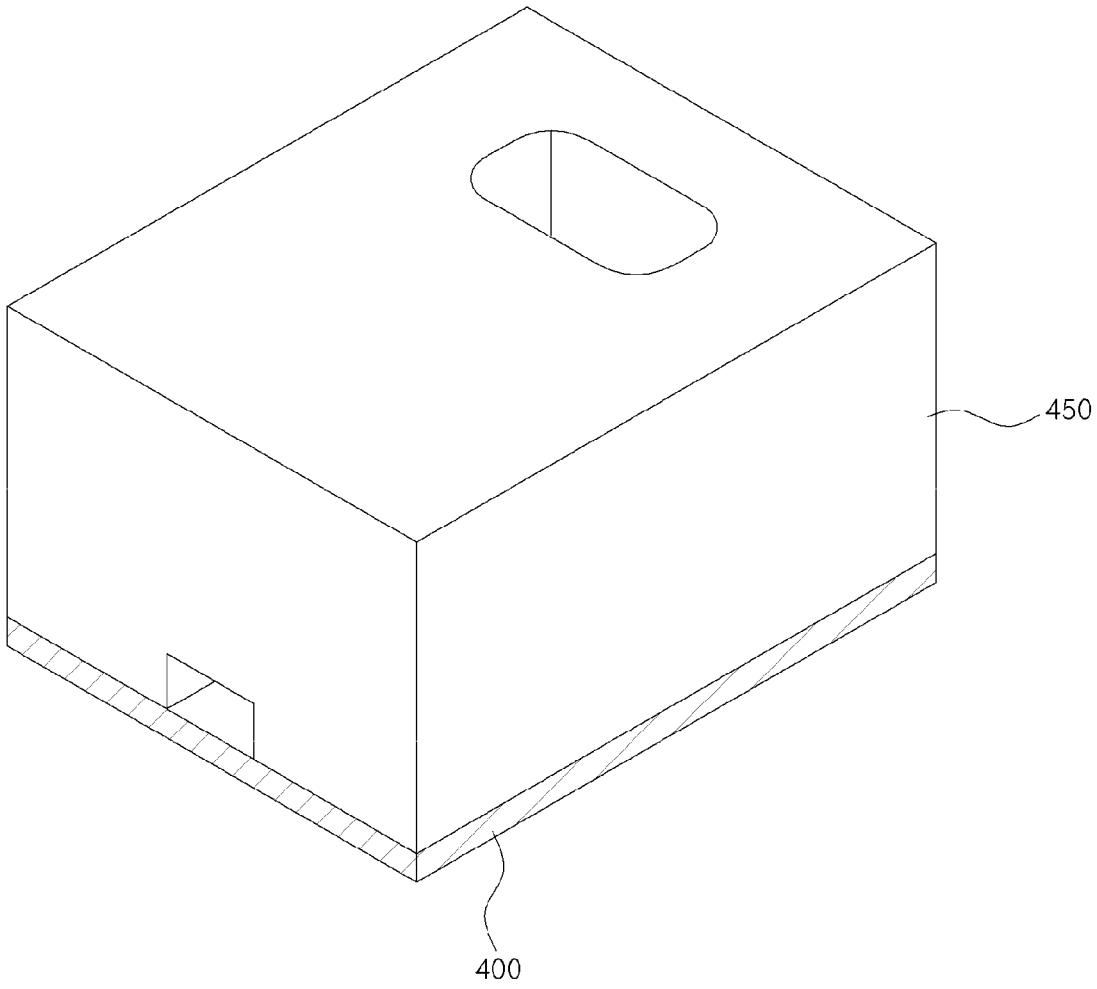
FIG. 4 is a perspective view of an adaptor for connecting a microstrip line with a waveguide according to an embodiment of the invention.

FIG. 4 is a perspective view showing the outside of an adaptor for connecting a microstrip line with a waveguide according to an embodiment of the invention.

Referring to FIG. 4, an adaptor for connecting a microstrip line with a waveguide according to an embodiment of the invention may include a microstrip line part 400 and a waveguide part 450.

The microstrip line part 400 may be implemented in the form of a microstrip line pattern on a substrate 410, and may transfer RF signals by using the microstrip pattern.

The waveguide part 450 may be structured as a housing having a hole formed therein for guiding waves, and may guide signals by way of the hole.

An adaptor according to an embodiment of the invention can be formed with the waveguide part 450 stacked over the microstrip line part 400.

Signals outputted from the microstrip line part 400 may be provided to the waveguide part 450, and conversely, signals outputted from the waveguide part 450 may be provided to the microstrip line part 400.

Figure 5:
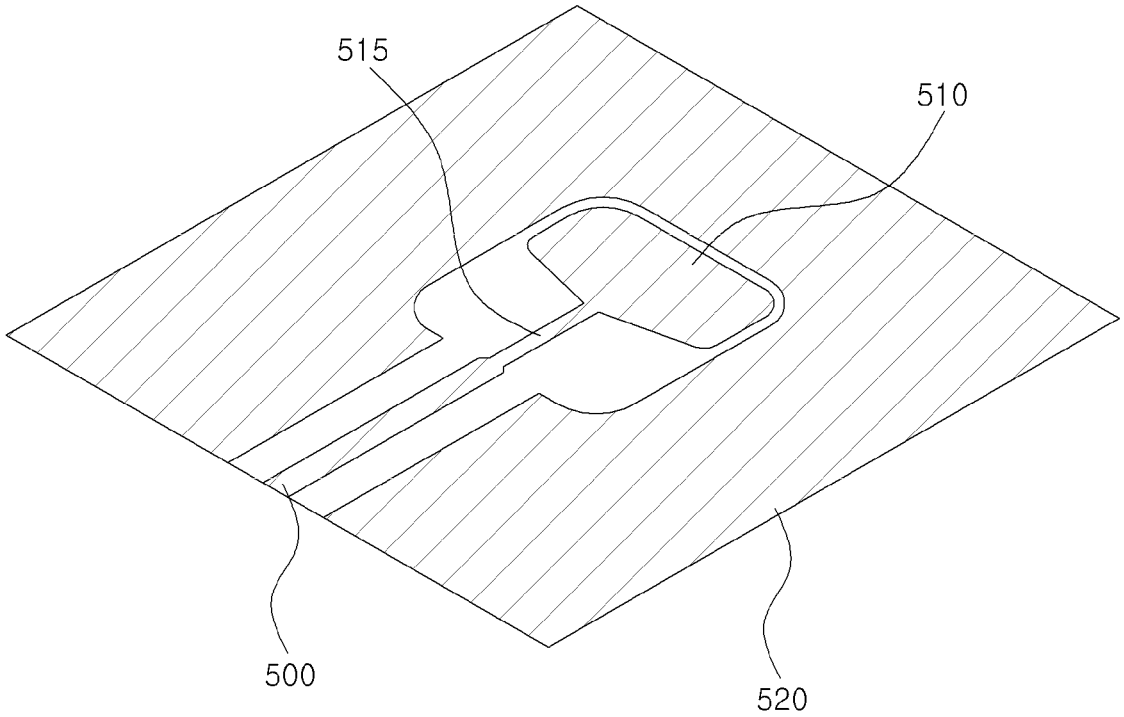
FIG. 5 is a view of an upper pattern of the microstrip line part in an adaptor for connecting a microstrip line with a waveguide according to an embodiment of the invention.

FIG. 5 is a view illustrating an upper pattern of the microstrip line part in an adaptor for connecting a microstrip line with a waveguide according to an embodiment of the invention.

Referring to FIG. 5, a microstrip line part 400 (FIG. 4) according to an embodiment of the invention may include a microstrip port pattern 500, a patch pattern 510, and a ground pattern 520.

The microstrip port pattern 500 may serve as an interface for joining to a microstrip device that is connected to the adaptor. Here, examples of a microstrip device can include a radar antenna implemented as a microstrip line and a microstrip transmission line.

The microstrip port pattern 500 may be separated by a particular distance from the ground pattern 520 and may take the form of an elongated line.

The microstrip port pattern 500 may be electromagnetically connected with a microstrip pattern of the microstrip device connecting to the adaptor, to receive or provide signals from or to the microstrip device.

As illustrated in FIG. 5, one end of the microstrip port pattern 500 may connect with a microstrip device, while the other end of the microstrip port pattern 500 may be joined with the patch pattern 510.

The patch pattern 510 can have a form similar to the shape of the waveguide hole of the waveguide part 450 but is not thus limited.

The patch pattern 510 may operate as a sort of radiator for signals provided from the microstrip port. By way of radiation from the patch pattern 510, the signals of the microstrip port pattern 500 may be provided to the waveguide part 450 (FIG. 4).

Referring to FIG. 5, in the upper area of the substrate on which the patterns are formed, a ground pattern 520 may be formed surrounding the microstrip port pattern 500 and patch pattern 510, with a particular distance from the microstrip port pattern 500 and patch pattern 510. The ground pattern 520 may be a pattern that is electrically connected with a ground to allow grounding.

Although it is not shown in the drawings, a ground pattern for electrical grounding can also be joined to the lower portion of the substrate.

Also, a matching pattern 515 can be formed between the microstrip port pattern 500 and the patch pattern 510 for impedance matching.

Figure 6:
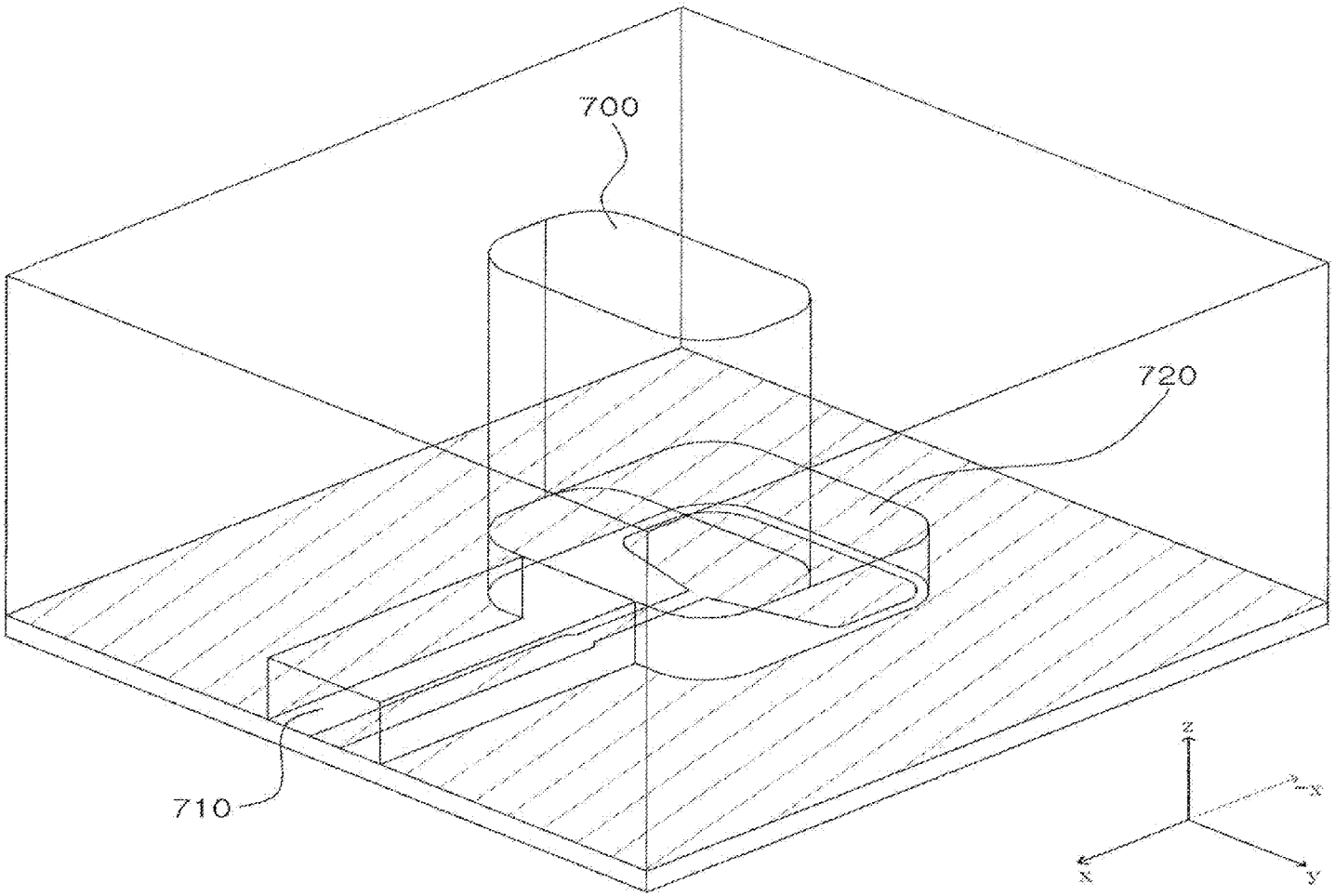
FIG. 6 is a perspective view of an adaptor for connecting a microstrip line with a waveguide according to an embodiment of the invention, with certain portions made transparent.
Figure 7:
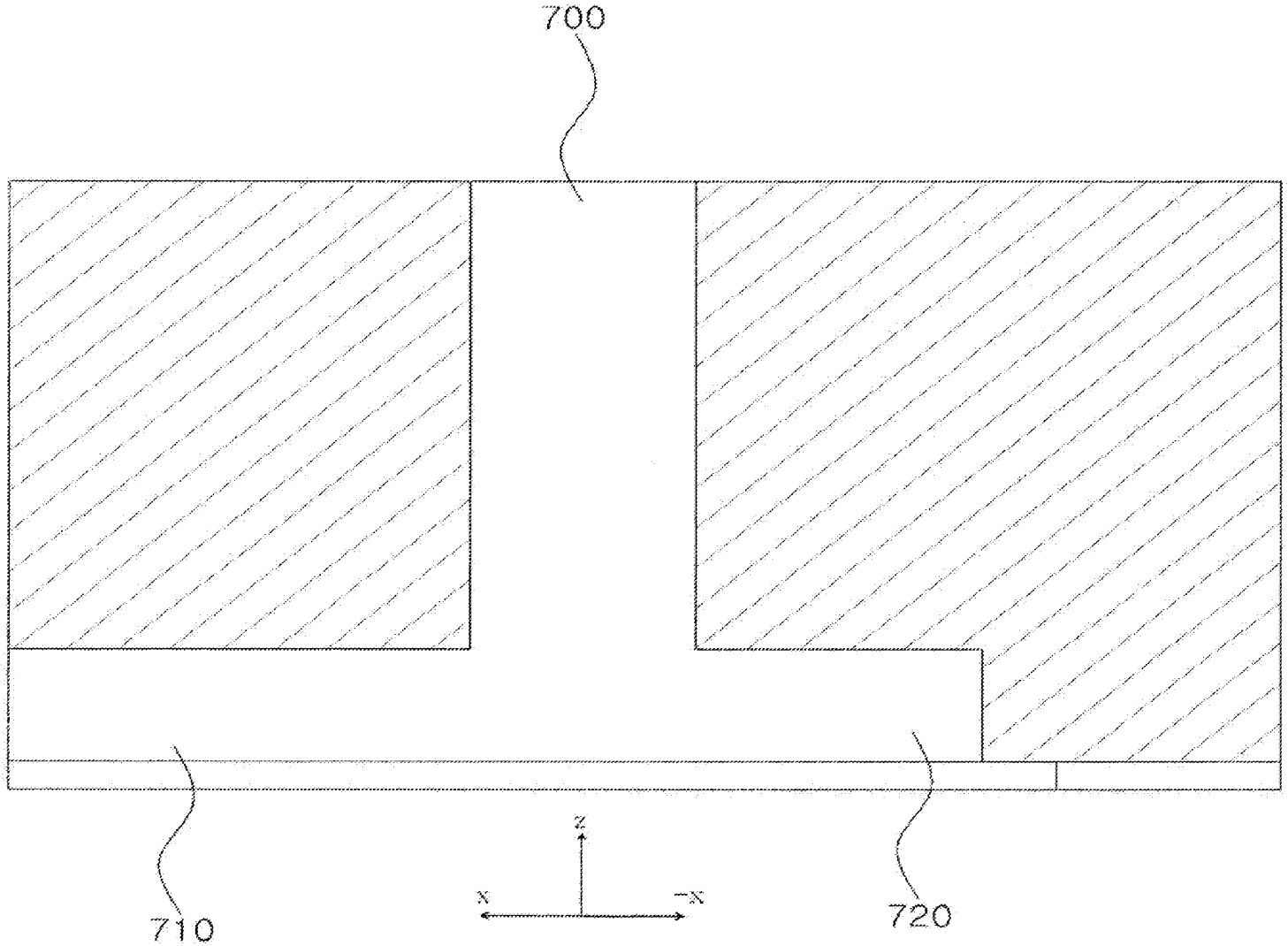
FIG. 7 is a cross-sectional view of an adaptor for connecting a microstrip line with a waveguide according to an embodiment of the invention.

FIG. 6 is a perspective view of an adaptor for connecting a microstrip line with a waveguide according to an embodiment of the invention with certain portions made transparent, and FIG. 7 is a cross-sectional view of an adaptor for connecting a microstrip line with a waveguide according to an embodiment of the invention.

Referring to FIG. 6 and FIG. 7, a waveguide part according to an embodiment of the invention can have the structure of a housing having holes formed therein.

The holes formed in the waveguide part can include a waveguide hole 700, a channel hole 710, and a stub hole 720.

The waveguide hole 700 may serve as a waveguide through which signals provided from the microstrip line part may be transmitted. The patch pattern 510 (FIG. 5) of the microstrip line part 400 may radiate the signals of the microstrip line part 400 (FIG. 4), and the signals radiated by the patch pattern 510 (FIG. 5) may be outputted from the waveguide part 450 through the waveguide hole 700.

The waveguide hole 700 may be formed penetrating the housing of the waveguide part 450 along its lengthwise direction.

The waveguide hole 700 can have the same form as that of the hole formed in a typical waveguide, and the waveguide hole 700 may enable the transmission of RF signals. The end portion of the waveguide hole 700 can be joined with another device for receiving the RF signals.

In the area where the microstrip line part 400 and the waveguide part 450 are joined together, a channel hole 710 and a stub hole 720 may be formed.

The channel hole 710 may be formed in a direction orthogonal to the direction of the waveguide hole 700 (i.e. in the +x direction of the x-y-z coordinate system). The channel hole 710 may be formed along the lengthwise direction of the microstrip port of the microstrip line part 400, which is orthogonal to the direction of the waveguide hole 700. Because of the channel hole 710, a portion of the sidewall of the housing of the waveguide part 450 may be open.

As illustrated in FIG. 6 and FIG. 7, the channel hole 710 may be formed parallel to the microstrip port pattern 500, and the channel hole 710 may provide a space in which to allow the transmission of signals through the microstrip port pattern 500.

The stub hole 720 may be formed in a direction that is orthogonal to that of the waveguide hole but opposite to the direction of the channel hole (i.e. in the −x direction of the x-y-z coordinate system). The stub hole 720 may operate as a sort of stub for the waveguide hole 700 and may have a preset length.

It may be preferable to form the stub hole 720 such that the length from the center portion of the waveguide hole 700 in the direction orthogonal to the waveguide hole 700 is a quarter of the wavelength ($\lambda/4$).

The stub hole 720 may serve to guide the signals radiated from patch pattern 510 of the microstrip line part 400 towards the waveguide hole 700.

Unlike the adaptor based on the related art, an adaptor based on an embodiment of the invention may have the waveguide part 450 joined only to the upper portion of the microstrip line part 400, with no separate member joined to the lower portion of the microstrip line part 400.

Therefore, it is possible to use a microstrip line having another layer joined beneath the microstrip line part 400. For example, the microstrip line part 400 illustrated in FIG. 5 can have joined thereto another substrate on which a different circuit pattern is printed.

Thus, the adaptor structure according to an embodiment of the invention makes it possible to use multiple layers of substrates for the microstrip line part 400.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. An adaptor for connecting a microstrip line and a waveguide, the adaptor comprising:

a microstrip line part including a microstrip port pattern and a patch pattern on an upper portion of a substrate, the patch pattern joined to an end portion of the microstrip port pattern; and a waveguide part joined to an upper portion of the microstrip line part, the waveguide part comprising:

a waveguide hole for transferring a signal provided from the patch pattern;

a channel hole formed in an area for joining with the microstrip line part along a first direction orthogonal to a direction of the waveguide hole in correspondence to the microstrip port pattern, the channel hole connected with the waveguide hole; and a stub hole connected with the waveguide hole and formed in an area for joining with the microstrip line part along a second direction opposite to the first direction, wherein at least a portion of the patch pattern is positioned within the stub hole.

2. The adaptor of claim 1, wherein a ground pattern is formed on an upper portion of the substrate, the ground pattern separated by a particular distance from the microstrip port pattern and the patch pattern to be formed around the microstrip port pattern and the patch pattern.

3. The adaptor of claim 2, wherein the stub hole is formed such that a distance from a center portion of the waveguide hole to an end portion of the stub hole is a quarter of a wavelength.

4. The adaptor of claim 3, wherein the waveguide hole is formed penetrating through a housing of the waveguide part.

5. The adaptor of claim 3, wherein the waveguide part comprises a housing having the waveguide hole, the channel hole, and the stub hole formed therein, and the channel hole is formed in a direction orthogonal to the waveguide hole from the waveguide hole up to a sidewall of the housing of the waveguide part.

* * * * *